US005189750A

United States Patent [19]

Brennan

[11] Patent Number: 5,189,750

[45] Date of Patent: Mar. 2, 1993

[54] COMBINATION BOTTLE OPENER AND CAN OPENER

[76] Inventor: Sean M. Brennan, 1750 Croner Ave., Menlo Park, Calif. 94025

[21] Appl. No.: 727,029

[22] Filed: Jul. 8, 1991

[51] Int. Cl.[5] ..... B67B 7/44; B25F 1/04

[52] U.S. Cl. ..... 7/152; 81/3.09; 81/3.55; 81/3.57

[58] Field of Search ..... 7/151, 152, 156; 81/3.07, 3.09, 3.55, 3.57

[56] References Cited

U.S. PATENT DOCUMENTS

| | | | |
|---|---|---|---|
| D. 168,053 | 10/1952 | La Forte . | |
| 1,082,800 | 12/1913 | Darqué . | |
| 1,364,016 | 12/1920 | Worthington . | |
| 1,507,093 | 9/1924 | Schioniger . | |
| 1,669,311 | 5/1928 | Strengberg . | |
| 2,257,532 | 9/1941 | Perocco | 81/3.09 |
| 2,412,946 | 12/1946 | Bloomfield . | |
| 2,413,528 | 12/1946 | Speaker | 7/152 |
| 2,483,456 | 10/1949 | Campos | 81/3.09 |
| 2,546,257 | 3/1951 | Eckman | 7/152 |
| 2,716,277 | 8/1955 | Riley | 7/152 |
| 2,733,505 | 2/1956 | Kenington | 7/152 |
| 4,300,288 | 11/1981 | Blyakharov et al. . | |

FOREIGN PATENT DOCUMENTS

| | | | |
|---|---|---|---|
| 802610 | 2/1951 | Fed. Rep. of Germany | 7/152 |
| 817711 | 5/1937 | France | 7/153 |
| 820407 | 8/1937 | France | 7/152 |
| 908801 | 10/1945 | France | 7/153 |

*Primary Examiner*—Roscoe V. Parker
*Attorney, Agent, or Firm*—Robert J. Koch

[57] ABSTRACT

A combination bottle opener and can opener is disclosed. A bottle opening element may be movably connected to a can opening element. The bottle opening element may include a first end having an angled portion and a protrusion that cooperate to define a bottle cap receiving area. The bottle opening element may also include an angled body section. The can opening element may include a cutting blade pivotally connected to a body part. The cutting blade may include a cutting edge, a cut-out portion and a plurality of projections. The body part may include a strengthening rib, a tapered edge and a can rim receiving notch. In an open, extended position the combination opener has length greater than the bottle opening element or can opening element alone. This greater length increases the leverage and decreases the amount of force necessary to open a bottle or can, respectively. In a closed position the cutting blade is folded against the body part and is substantially enclosed by the bottle opening element and the body part. In the closed position the combination opener may be compactly carried in a shirt or pant pocket with little likelihood of the cutting blade causing injury to the clothes or the body of the user.

20 Claims, 3 Drawing Sheets

Fig. 1
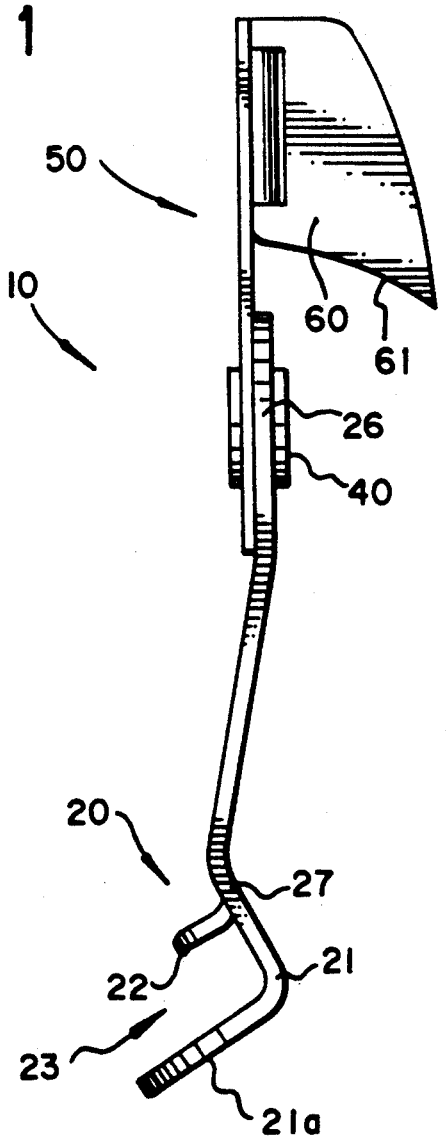
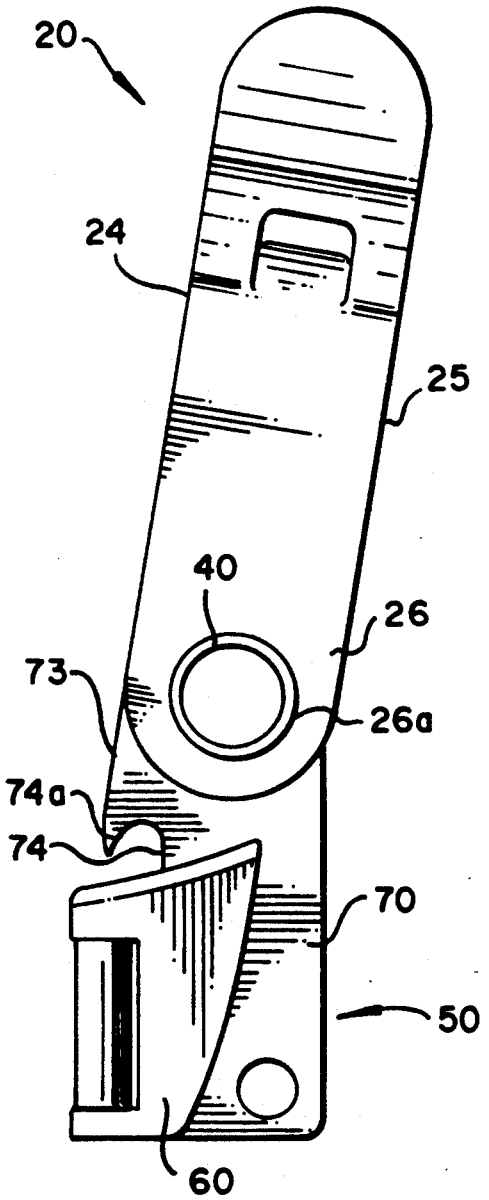
Fig. 2

COMBINATION BOTTLE OPENER AND CAN OPENER

BACKGROUND OF THE INVENTION

1. Field of the Invention

The invention relates to a combination bottle opener and can opener, in particular, a combination bottle opener and can opener designed to have a compact closed configuration and be safely carried in a users' pocket without injury to the user or the user's clothing.

2. Description of the Related Technology

U.S. Pat. No. 1,507,093 discloses a folding can opener with a body portion 1 having a fixed attached hook 2 used to open caps of bottles. The body portion is attached to cutter blade 5 having a sharp point 10 for opening cans. In storage, the cutter blade 5 is held in position by a guard 13 that covers only a portion of the cutter blade.

U.S. Pat. No. 1,364,016 discloses two embodiments of a can opener. The first embodiment has an upset angular portion 22 for removing metal caps from bottles and cutters 27 for cutting a can top.

U.S. Pat. No. 2,716,277 discloses a container opener with pivoted guard. The container opener has a tin can incisor device 18 and a bottle decapping portion 19.

SUMMARY OF THE INVENTION

It is an object of the invention to provide a combination bottle opener and can opener which has an open position of extended length and sufficient leverage to minimize the forces necessary to open an article, i.e., a bottle or can, and which has a closed position sufficiently compact to be carried in a shirt or pant's pocket of the user, while maximizing safety with little likelihood of the combination opener causing injury to the clothes or the body of the user.

The invention relates to a combination bottle opener and can opener having a bottle opening element for removing a bottle cap from a can, and a can opening element which is used for opening a can. The combination opener is extended to an open position of sufficient length and increased leverage to minimize the force applied by the user to open a bottle or can. Advantageously, the combination opener has the edges of the bottle opening element and the can opening element aligned along one side to facilitate opening a bottle or can, respectively. The bottle opening element is movably or pivotally connected to the can opening element. The bottle opening element may also include an angled body section providing a snug fit between the components.

The can opening element may include a cutting blade articulated to a body part. The cutting blade may include a cutting edge and a cut-out portion that receives a hinge part of the body part to form a hinged connection. The cutting blade may also include a plurality of projections that cooperate with edge portions on the can opening element to limit the rotation of the cutting blade when it is moved or pivoted to an open position. The can opening element includes a strengthening rib, a can rim receiving notch and a tapered edge. The tapered edge faces the can and provides additional clearance between the can opening element and the can. In an advantageous development of the invention, the cutting blade is folded against the body part of the can opening element and is substantially enclosed by the bottle opening element and the body part in a closed position. In this closed configuration there is little likelihood of the cutting blade opening and causing injury to the clothes or the body of the user.

Further objects, features and advantages of the present invention will become apparent from the detailed description of preferred embodiments which follows, when considered together with the attached figures of the drawing.

BRIEF DESCRIPTION OF THE DRAWINGS

FIG. 1 illustrates a side elevation of a combination bottle opener and can opener according to an embodiment of the invention;

FIG. 2 illustrates a top plan view of the embodiment in an open position with the side edges of the bottle opening element and the can opening element substantially aligned along one side;

DESCRIPTION OF THE PREFERRED EMBODIMENT

Figure 3:
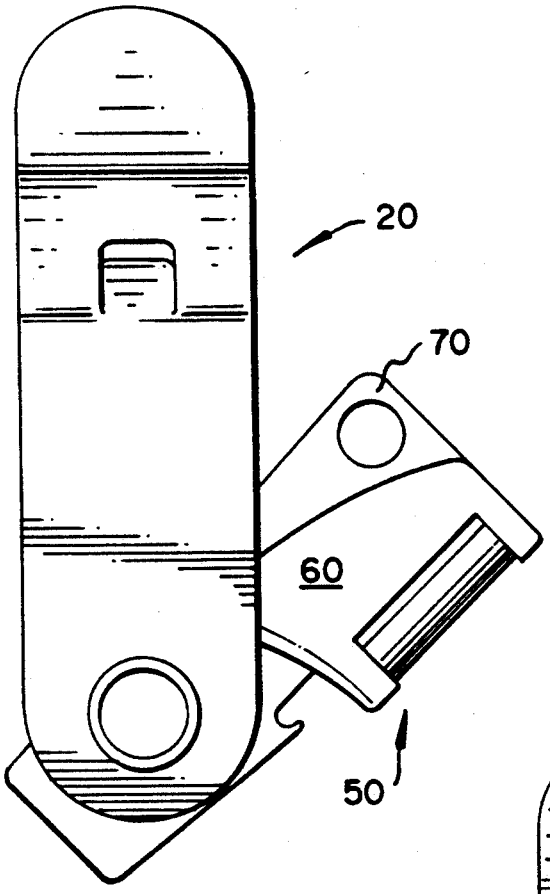
FIG. 3 illustrates a top plan view of the embodiment of FIG. 1 in a partially closed position with a portion of the cutting blade contacting the bottle opening element and the body part of the can opening element.

FIGS. 1–4 show a combination bottle opener and can opener 10 according to an embodiment of the invention. Combination opener 10 includes a bottle opening element 20 and a can opening element 50. Bottle opening element 20 is pivotally connected to can opening element 50, preferably by a pin connection 40. By appropriately sizing pin connection 40 a key ring or key chain may be passed through pin connection 40. Thus, the invention may be attached to a key chain or key ring so as to lay flat against the keys in a compact fashion. Preferably, bottle opening element 20 is formed from an elongated metal sheet. As shown in FIGS. 1 and 2, bottle opening element 20 includes a body portion or first end 21 and a second end 26 having a pivot hole **26*a*. First end 21 includes an angled portion 21*a* and a protrusion 22. Facing sides of angled portion 21*a* and protrusion 22 define a bottle cap receiving area 23. Bottle opening element 20 includes a first edge 24, a second edge 25 and preferably includes an angled body section 27. The angled body section provides a snug fit when the can opening element is moved into substantial surface contact with the bottle opening element in the closed position. This snug fit is a safety feature that minimizes the likelihood of the can opening element sliding out of substantial contact with the bottle opening element. The snug fit may be provided in any conventional manner. If the embodiment of the invention includes angled body section 27, the snug fit may be provided by the bending resulting from the angled body section and the can opening element contacting when the invention is moved to the closed position. It is not necessary to include angled body section 27**, yet still maintain a snug fit in the closed position. It is merely necessary to provide a clearance between the can opening element and the bottle opening element that is less than or equal to the thickness of the cutting blade. When the invention is moved to the closed position, the insufficient clearance will cause substantial contact between the cutting blade and the bottle opening portion, in addition to the substantial contact between the cutting blade and the body part, to provide the snug fit.

FIGS. 1 and 2 also show the combination opener in an open position extended to full length. The extended position provides increased leverage or a mechanical advantage for opening an article such as a can.

Prior art can openers use detent mechanisms or tabs to prevent the cutting blade from accidentally opening from the closed position and causing injury to the clothing or body of the user. The detents or tabs wear away through use over a period of time. Thus, after repeated use the prior art can openers no longer have a mechanism for preventing the cutting blade from accidentally opening. The invention provides a safety feature preventing accidental opening of the invention by snugly locating the components in the closed position. It is advantageous to substantially cover and snugly locate the cutting blade between the body part and the bottle opening element in a closed position. The folding configuration and snug fit of the components of the invention continue to prevent the cutting blade from accidentally opening from the closed position, even after repeated use.

FIG. 2 shows the combination opener in an extended position. First edge 24 of the bottle opening element is preferably substantially aligned and flush with a tapered edge 73 of the can opening element. This flush alignment of the edges facilitates the movement of the bottle opening element as it slides past the edge of a can being opened. The flush alignment also provides an advantage when the combination opener is in the closed position. When closed (see FIG. 4) the edge of the bottle opening element below a can rim receiving notch 74 lines up with the other side of the bottle opener. Only the hinge connection of the can opening element extends past the bottle opening element.

Figure 4:
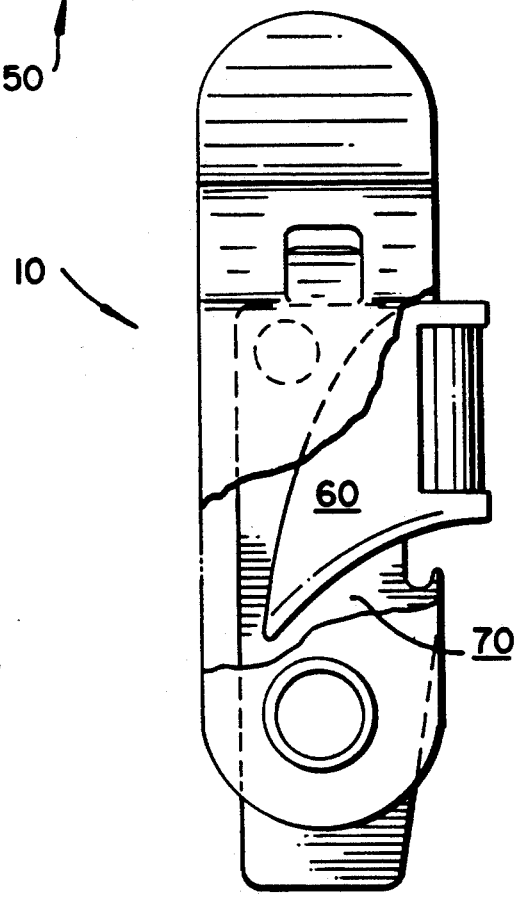
FIG. 4 illustrates a partially cut-away top plan view of the embodiment of FIG. 1 in a closed position with the cutting blade substantially located between the bottle opening element and the body part.

FIGS. 3 and 4 show the combination opener in a partially closed and in a closed configuration, respectively. Can opening element 50 includes a cutting blade 60 articulated to a body part 70. Cutting blade 60 includes a cutting edge 61. In FIG. 3 the can opening element is in a partially closed position with just a portion of cutting blade 60 covered by body part 70 and bottle opening element 20. FIG. 4 shows a partially cut-away view of the combination opener in a closed position. Cutting blade 60 is safely and securely positioned between body part 70 and bottle opening element 20.

As shown in FIG. 4, the combination opener has a compact configuration in the closed position. As an advantage of the invention, the bottle opening element is still functional and can be used to open bottles when the device is in the closed position. The particular location of pivot connection 40 is preferably determined so the can opening element in a closed configuration is compact, does not hinder the functionality of the bottle opening element, and allows the bottle opening element and can opening element to be aligned along one edge when in the open position.

Figure 5:
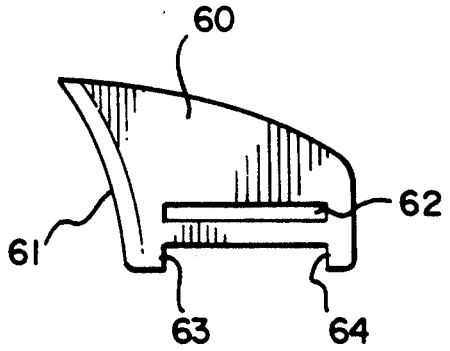
FIG. 5 illustrates a top plan view of the cutting blade.
Figure 6:
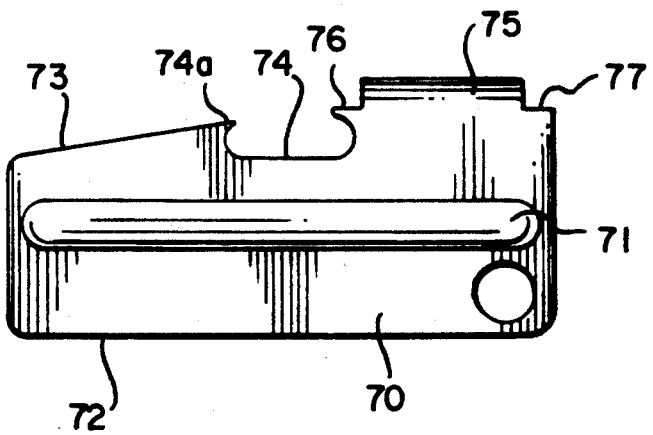
FIG. 6 illustrates a bottom plan view of the body part of the embodiment of FIG. 1.

FIGS. 5 and 6 show details of the can opening element. As shown in FIG. 5 cutting blade 60 includes cutting edge 61, a cut-out portion 62 and first and second projections 63, 64. FIG. 6 shows body part 70 which preferably includes strangthening rib 71, first edge 72 and a second edge 73 that is preferably tapered. Body part 70 also includes a notch 74 which has a sharp corner or fulcrum point **74*a*. Notch 74 facilitates placement of the can opening element on a can. In use, sharp point 74*a* rides beneath the can rim and acts as a fulcrum point for the can opening element. Body part 70 also includes a hinge part 75 and first and second side edge portions 76, 77. Second edge 73 of the body part is preferably tapered to provide a clearance between the can opening element and the can to be opened, which facilitates opening the can. Hinge part 75 passes through cut-out portion 62 to form a hinge connection between the cutting blade and the body part. First and second portions 63, 64 and first and second side edge portions 76, 77** cooperate to limit the rotation of the cutting blade in the open position. Preferably, the cutting blade pivots to an open position of about 90 degrees for opening a can.

It is understood that the foregoing description is for illustrative purposes only. To those skilled in the art, it will be apparent that the invention is capable of taking various useful forms and the scope of the invention is to be determined by the appended claims.

What is claimed is:

1. A combination bottle opener and can opener comprising:

a bottle opening element exhibiting a body portion, an angled surface and a protrusion, said angled surface and protrusion defining a bottle cap receiving portion; and a can opening element including a body part and a cutting blade articulably connected to said body part; said can opening element being movably connected to said bottle opening element.

2. A combination bottle opener and can opener according to claim 1 further comprising:

a can rim receiving notch located on said body part.

3. A combination bottle opener and can opener according to claim 2, wherein said can rim receiving notch exhibits a fulcrum point.

4. A combination bottle opener and can opener according to claim 1 further comprising a strengthening rib located on said body part.

5. A combination bottle opener and can opener according to claim 1 further comprising:

a hinge part located on said body part.

6. A combination bottle opener and can opener according to claim 1 wherein said body part exhibits a tapered edge.

7. A combination bottle opener and can opener according to claim 1, wherein said cutting blade is rotatably connected to said body part; said combination opener further comprising:

a cutting blade rotation limiter located on said can opening element.

8. A combination bottle opener and can opener according to claim 7 wherein said cutting blade rotation limiter further comprises two spaced-apart edge portions.

9. A combination bottle opener and can opener according to claim 7 wherein said cutting blade rotation limiter further comprises two spaced-apart projections.

10. A combination bottle opener and can opener according to claim 1 wherein said cutting blade exhibits a hinge part receiving cut-out portion.

11. A combination bottle opener and can opener according to claim 1 wherein said body portion exhibits an angled body section.

12. A combination bottle opener and can opener according to claim 1, wherein said combination opener is configured so said cutting blade is substantially covered by and located between said body part and said body portion in a closed position.

13. A combination bottle opener and can opener comprising:

bottle opening means for opening a bottle;

can opening means for opening a can;

cutting means for cutting a can, said cutting means located on and pivotally connected to said can opening means;

rotation limiting means for limiting the rotation of said cutting means and located on said can opening means; and connecting means for movably connecting said bottle opening means to said can opening means.

14. A combination bottle opener and can opener according to claim 13, wherein said bottle opening means further comprises:

an angled part; and a protrusion.

15. A combination can opener and bottle opener according to claim 13, wherein said can opening means further comprises:

a body part exhibiting a hinge part; and a hinge part receiving cut-out portion located on said cutting means.

16. A combination bottle opener and can opener according to claim 13, wherein said connecting means is a pivotal connection.

17. A combination bottle opener and can opener according to claim 13, wherein said connecting means is a pin connection.

18. A method of using a combination bottle opener and can opener comprising a bottle opening portion and a can opening portion having a cutting blade movably connected to a body part, the bottle opening portion being movably connected to the can opening portion, said method comprising the steps of:

aligning an edge of the bottle opening portion substantially flush with an edge of the can opening portion; and opening an article.

19. A method according to claim 18 wherein the article is a bottle, the step of opening an article further comprising the steps of:

placing a bottle cap receiving portion of the combination opener on the bottle; and opening the bottle.

20. A method according to claim 18 wherein the article is a can, the step of opening an article further comprising the steps of:

moving the cutting blade to a position substantially perpendicular to the body part of the can opening portion;

placing the can opening portion on the can; and opening the can.

* * * * *